US009182696B2

(12) United States Patent
Ozawa et al.

(10) Patent No.: US 9,182,696 B2
(45) Date of Patent: Nov. 10, 2015

(54) MAGNETIC TONER FOR DEVELOPING ELECTROSTATIC LATENT IMAGE

(71) Applicant: KYOCERA Document Solutions Inc., Osaka (JP)

(72) Inventors: Yoshio Ozawa, Osaka (JP); Toshiki Takemori, Osaka (JP); Masanori Sugahara, Osaka (JP); Hiroaki Moriyama, Osaka (JP); Masashi Tamagaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/338,626

(22) Filed: Jul. 23, 2014

(65) Prior Publication Data

US 2015/0030978 A1 Jan. 29, 2015

(30) Foreign Application Priority Data

Jul. 25, 2013 (JP) ..... 2013-154909

(51) Int. Cl.
*G03G 9/083* (2006.01)
*G03G 9/093* (2006.01)

(52) U.S. Cl.
CPC ..... *G03G 9/09328* (2013.01); *G03G 9/09307* (2013.01); *G03G 9/09385* (2013.01)

(58) Field of Classification Search
CPC ... G03G 9/0836; G03G 9/0819; G03G 9/083; G03G 9/09392; G03G 9/09328; G03G 9/09321
See application file for complete search history.

(56) References Cited

U.S. PATENT DOCUMENTS

| | | | | |
|---|---|---|---|---|
| 4,610,945 | A | 9/1986 | Matsuoka et al. | |
| 2005/0271964 | A1 | 12/2005 | Etou et al. | |
| 2013/0280650 | A1 * | 10/2013 | Sugama et al. ..... | 430/109.3 |

FOREIGN PATENT DOCUMENTS

| | | | |
|---|---|---|---|
| JP | S60-128458 | A | 7/1985 |
| JP | 2004-138985 | A | 5/2004 |

OTHER PUBLICATIONS

An Office Action; "Notice of Reasons for Rejection," issued by the Japanese Patent Office on Jul. 28, 2015, which corresponds to Japanese Patent Application No. 2013-154909 and is related to U.S. Appl. No. 14/338,626.

* cited by examiner

*Primary Examiner* — Hoa V Le
(74) *Attorney, Agent, or Firm* — Studebaker & Brackett PC

(57) ABSTRACT

A magnetic toner for developing an electrostatic latent image of the present disclosure includes toner particles each having a toner core containing a binder resin and a magnetic powder, and a shell layer coating a surface of the toner core. The shell layer contains a unit derived from a monomer of a thermosetting resin and a unit derived from a thermoplastic resin. The thermosetting resin is one or more resins selected from the group of amino resins consisting of a melamine resin, a urea resin, and a glyoxal resin. The amount of iron eluted from the toner core (iron concentration in a filtrate) measured by a specified method is 10 mg/L or less.

3 Claims, 1 Drawing Sheet

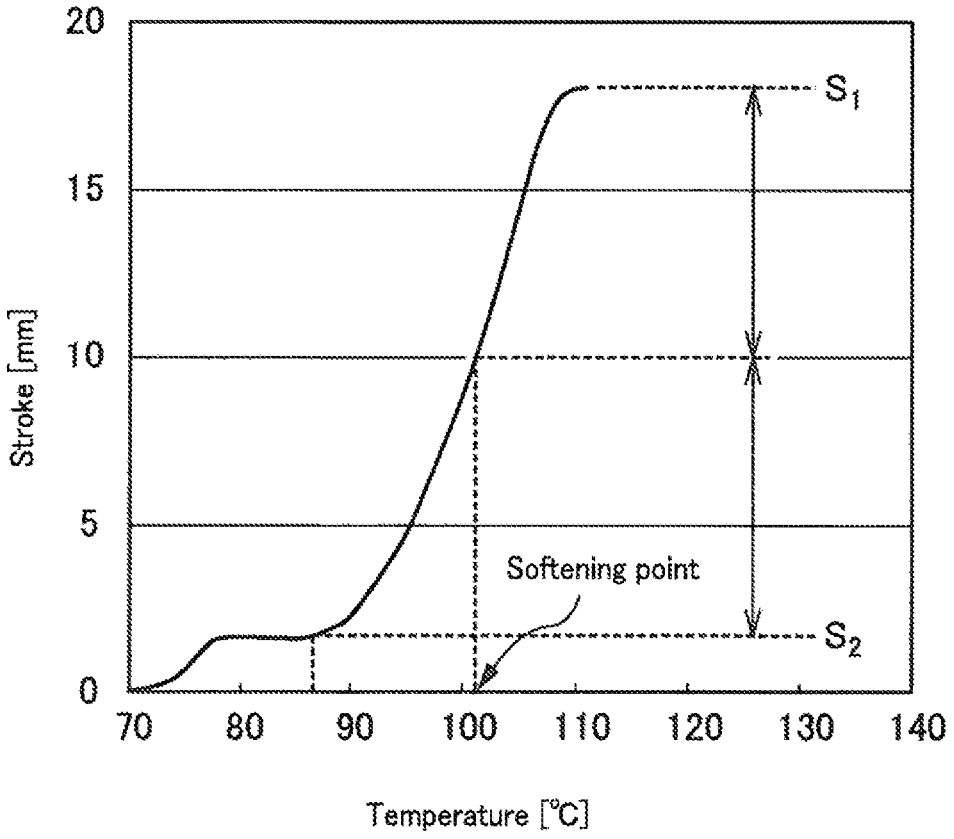
20
15
10
5
0
Stroke [mm]
70
80
90
100
110
120
130
140
Temperature [°C]
S1
S2
Softening point

MAGNETIC TONER FOR DEVELOPING ELECTROSTATIC LATENT IMAGE

INCORPORATION BY REFERENCE

The present application claims priority under 35 U.S.C. §119 to Japanese Patent Application No. 2013-154909, filed Jul. 25, 2013. The contents of this application are incorporated herein by reference in their entirety.

BACKGROUND

The present disclosure relates to magnetic toners for developing an electrostatic latent image.

For energy saving and downsizing of an image forming apparatus, there is a demand for a toner excellent in low-temperature fixability. If a toner excellent in the low-temperature fixability is used, a toner can be satisfactorily fixed on a recording medium even if the temperature of a fixing roller is low.

In order to obtain a toner excellent in the low-temperature fixability, a method for producing a toner by using a binder resin having a low melting point (or a binder resin having a low glass transition point) and a mold releasing agent having a low melting point has been proposed. It is, however, difficult to produce a toner excellent in high-temperature preservability by this method. The high-temperature preservability of a toner refers to a property that toner particles contained in the toner are not aggregated even if the toner is stored under a high-temperature environment. In a toner poor in the high-temperature preservability, toner particles are liable to aggregate under a high-temperature environment. When the toner particles aggregate, the charge amount of the toner particles are likely to be lowered.

For purpose of improving the low-temperature fixability, high-temperature preservability, and blocking resistance of a toner, a toner containing toner particles having a core-shell structure has been proposed.

In an exemplified toner containing toner particles having a core-shell structure, a toner core contains a binder resin having a low melting point. Besides, the toner core is coated with a shell layer made of a resin. In addition, the resin constituting the shell layer has a higher glass transition point (Tg) than the binder resin contained in the toner core.

In another exemplified toner containing toner particles having a core-shell structure, the surface of a toner core is coated with a thin film (shell layer) containing a thermosetting resin. The toner core has a softening point of 40° C. or more and 150° C. or less.

SUMMARY

A magnetic toner for developing an electrostatic latent image of the present disclosure includes toner particles each having a toner core containing a binder resin and a magnetic powder, and a shell layer coating a surface of the toner core. The shell layer contains a unit derived from a monomer of a thermosetting resin and a unit derived from a thermoplastic resin. The thermosetting resin is one or more resins selected from the group of amino resins consisting of a melamine resin, a urea resin, and a glyoxal resin. The amount of iron eluted from the toner core is 10 mg/L or less. The amount of iron eluted from the toner core is measured through: keeping 2 g of the toner core suspended at 60° C. for 6 hours in 50 mL of an aqueous solution of benzohydroxamic acid having a pH adjusted to 4 and a concentration of 2% by mass to obtain a suspension; filtering the suspension containing the toner core to obtain a filtrate; measuring the absorbance of the filtrate for a light beam having a wavelength of 440 nm; and measuring the amount of iron eluted from the toner core as an iron concentration in the filtrate based on the absorbance with a standard curve.

BRIEF DESCRIPTION OF THE DRAWINGS

FIG. 1 is a graph representation of a method for measuring a softening point by using an elevated flow tester.

DETAILED DESCRIPTION

An embodiment of the present disclosure will now be described in details. The present disclosure is not limited to the following embodiment at all but can be practiced with changes and modifications appropriately made within the scope of the object of the present disclosure. Incidentally, the description may be appropriately omitted in some cases for avoiding redundant description, which does not limit the gist of the present disclosure.

A toner according to the present embodiment is a magnetic toner for developing an electrostatic latent image. Each of toner particles contained in the toner has a toner core and a shell layer coating the toner core. The toner core contains a binder resin and a magnetic powder. The toner core may contain, in the binder resin, a component such as a colorant, a mold releasing agent, or a charge control agent if necessary. The shell layer is mainly constituted by a resin. The resin constituting the shell layer contains a unit derived from a monomer of a thermosetting resin and a unit derived from a thermoplastic resin.

The toner may contain the toner particles alone, or may contain a component other than the toner particles. An external additive may be adhered to the surface of each toner particle as occasion demands. Incidentally, a particle obtained before the treatment with an external additive is sometimes described as a toner mother particle in the following description and the appended claims.

Now, the components that can be contained in the toner core (the binder resin, the magnetic powder, the colorant, the mold releasing agent, and the charge control agent), the resin constituting the shell layer, the external additive, and a method for producing the toner will be successively described.

[Binder Resin]

In the toner of the present embodiment, the shell layer is formed on the surface of the toner core through a reaction, caused on the surface of the toner core, between the thermoplastic resin and the monomer of the thermosetting resin. Therefore, the binder resin is preferably a resin having, in a molecule, at least one of functional groups of a hydroxyl group, a carboxyl group, and an amino group, and is more preferably a resin having, in a molecule, a hydroxyl group and/or a carboxyl group. A hydroxyl group reacts with and chemically binds to a monomer of a thermosetting resin such as methylol melamine. Accordingly, if the toner is produced by using a binder resin having a hydroxyl group, the shell layer is firmly bound to the toner core in the prepared toner.

If the binder resin has a carboxyl group, the binder resin has an acid value of preferably 3 mgKOH/g or more and 50 mgKOH/g or less, and more preferably 10 mgKOH/g or more and 40 mgKOH/g or less. If the binder resin has a hydroxyl group, the binder resin has a hydroxyl value of preferably 10 mgKOH/g or more and 70 mgKOH/g or less, and more preferably 15 mgKOH/g or more and 50 mgKOH/g or less.

Specific examples of the binder resin include thermoplastic resins such as styrene-based resins, acrylic-based resins, styrene acrylic-based resins, polyethylene-based resins, polypropylene-based resins, vinyl chloride-based resins, polyester resins, polyamide-based resins, polyurethane-based resins, polyvinyl alcohol-based resins, vinyl ether-based resins, N-vinyl-based resins, and styrene-butadiene-based resins. Among these resins, a styrene acrylic-based resin or a polyester resin is preferably used from the viewpoint of improvement of the dispersibility of a colorant in the toner particles, the chargeability of the toner, and the fixability of the toner on a recording medium. The styrene acrylic-based resin and the polyester resin will now be described.

The styrene acrylic-based resin is a copolymer of a styrene-based monomer and an acrylic-based monomer. Specific examples of the styrene-based monomer include styrene, α-methylstyrene, p-hydroxystyrene, m-hydroxystyrene, vinyl toluene, α-chlorostyrene, o-chlorostyrene, m-chlorostyrene, p-chlorostyrene, and p-ethylstyrene. Specific examples of the acrylic-based monomer include (meth) acrylic acid; (meth)acrylic acid alkyl ester such as methyl (meth)acrylate, ethyl(meth)acrylate, n-propyl(meth)acrylate, iso-propyl(meth)acrylate, n-butyl(meth)acrylate, iso-butyl (meth)acrylate, or 2-ethylhexyl(meth)acrylate; and (meth) acrylic acid hydroxyalkyl ester such as 2-hydroxyethyl(meth) acrylate, 3-hydroxypropyl(meth)acrylate, 2-hydroxypropyl (meth)acrylate, or 4-hydroxypropyl(meth)acrylate.

In preparation of the styrene acrylic-based resin, a hydroxy group can be introduced into the styrene acrylic-based resin by using a monomer such as p-hydroxystyrene, m-hydroxystyrene, or (meth)acrylic acid hydroxyalkyl ester. By appropriately adjusting the amount of such a monomer having a hydroxyl group to be used, the hydroxyl value of the resultant styrene acrylic-based resin can be adjusted.

In preparation of the styrene acrylic-based resin, a carboxyl group can be introduced into the styrene acrylic-based resin by using (meth)acrylic acid as the monomer. By appropriately adjusting the amount of the (meth)acrylic acid to be used, the acid value of the resultant styrene acrylic-based resin can be adjusted.

The polyester resin can be obtained by condensation polymerization or co-condensation polymerization of a bivalent, trivalent, or higher valent alcohol and a bivalent, trivalent, or higher valent carboxylic acid, for example. Examples of components used in synthesizing the polyester resin include the following alcohols and carboxylic acids.

Specific examples of a bivalent alcohol used in synthesizing the polyester resin include diols such as ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol; and bisphenols such as bisphenol A, hydrogenated bisphenol A, polyoxyethylenated bisphenol A, and polyoxypropylene-modified bisphenol A.

Specific examples of a trivalent or higher valent alcohol used in synthesizing the polyester resin include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methyl propanetriol, 2-methyl-1,2,4-butanetriol, trimethylolethane, trimethylolpropane, and 1,3,5-trihydroxymethylbenzene.

Specific examples of a bivalent carboxylic acid used in synthesizing the polyester resin include maleic acid, fumaric acid, citraconic acid, itaconic acid, glutaconic acid, phthalic acid, isophthalic acid, terephthalic acid, cyclohexane dicarboxylic acid, adipic acid, sebacic acid, azelaic acid, malonic acid, succinic acid, and alkyl succinic acid or alkenyl succinic acid (n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, and isododecenyl succinic acid).

Specific examples of a trivalent or higher valent carboxylic acid used in synthesizing the polyester resin include 1,2,4-benzenetricarboxylic acid (trimellitic acid), 1,2,5-benzenetric arboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxy propane, 1,2,4-cyclohexanetricarboxylic acid, tetra(methylenecarboxyl) methane, 1,2,7,8-octanetetracarboxylic acid, pyromellitic acid, and Empol trimer acid.

Furthermore, any of the aforementioned bivalent, trivalent, or higher valent carboxylic acids may be used in the form of an ester-forming derivative such as an acid halide, an acid anhydride, or a lower alkyl ester. Here, a "lower alkyl" means an alkyl group having 1 to 6 carbon atoms.

The acid value and the hydroxyl value of the polyester resin can be adjusted by appropriately changing the amount of a bivalent, trivalent or higher valent alcohol and the amount of a bivalent, trivalent or higher valent carboxylic acid to be used in producing the polyester resin. Besides, the acid value and the hydroxy value of the polyester resin tend to be lowered by increasing the molecular weight of the polyester resin.

From the viewpoint of carbon neutral, the toner preferably contains a biomass-derived material. Specifically, a ratio of biomass-derived carbon in entire carbon contained in the toner is preferably 25% by mass or more and 90% by mass or less.

As the binder resin, a polyester resin synthesized by using a biomass-derived alcohol, such as 1,2-propanediol, 1,3-propanediol, or glycerin is preferably used.

The type of biomass is not especially limited, and the biomass may be plant biomass or animal biomass. Among various biomass-derived materials, a plant biomass-derived material is more preferably used because such a material is easily available in a large amount and is inexpensive.

An example of a method for producing glycerin from biomass includes a method in which vegetable oil or animal oil is hydrolyzed by a chemical method using an acid or a base, or by a biological method using an enzyme or microorganism. Alternatively, glycerin may be produced from a substrate containing saccharides such as glucose by a fermentation method. Alcohol such as 1,2-propanediol or 1,3-propanediol can be produced by using, as a raw material, the glycerin obtained as described above. The glycerin can be chemically transformed into a target substance by a known method.

As the binder resin, a styrene acrylic-based resin synthesized by using biomass-derived acrylic acid or acrylate is preferably used. By dehydrating the glycerin obtained as described above, acrolein can be obtained. Besides, by oxidizing the thus obtained acrolein, biomass-derived acrylic acid can be obtained. Furthermore, by esterifying the thus obtained biomass-derived acrylic acid by a known method, biomass-derived acrylate can be produced. If alcohol used in producing acrylate is methanol or ethanol, alcohol produced from biomass by a known method is preferably used.

In $CO_2$ present in the air, the concentration of $CO_2$ containing radioactive carbon ($^{14}C$) is retained constant in the air. On the other hand, plants incorporate $CO_2$ containing $^{14}C$ from the air during photosynthesis. Therefore, the concentration of $^{14}C$ in carbon contained in an organic component of a plant is occasionally equivalent to the concentration of $CO_2$ containing $^{14}C$ in the air. The concentration of $^{14}C$ in carbon contained in an organic component of a general plant is approximately 107.5 pMC (percent Modern Carbon). Besides, carbon present in animals is derived from carbon contained in plants. Therefore, the concentration of $^{14}C$ in carbon contained in an organic component of an animal also shows a similar tendency to that in a plant.

Assuming that the concentration of $^{14}C$ in the toner is X(pMC), the ratio of biomass-derived carbon in entire carbon contained in the toner can be obtained in accordance with formula (1): Ratio of biomass-derived carbon (mass %)=(X/107.5)×100.

From the viewpoint of the carbon neutral, a plastic product containing biomass-derived carbon in a ratio of 25% by mass or more in entire carbon contained in the product is particularly preferred. Such a plastic product is given a BiomassPla mark (certified by Japan BioPlastics Association). In the case where the ratio of the biomass-derived carbon in entire carbon contained in the toner is 25% by mass or more, the concentration X of $^{14}C$ in the toner is obtained in accordance with the above formula (1) as 26.9 pMC or more. Accordingly, the polyester resin is preferably prepared so that the concentration of the radioactive carbon isotope $^{14}C$ in the entire carbon contained in the toner can be 26.9 pMC or more. Incidentally, the concentration of $^{14}C$ in carbon contained in a petrochemical can be measured in accordance with ASTM-D6866.

The glass transition point ($Tg_r$) of the binder resin is preferably 30° C. or more and 60° C. or less, and more preferably 35° C. or more and 55° C. or less. The glass transition point ($Tg_r$) of the binder resin can be measured by the following method.

<Method for Measuring Glass Transition Point>

The glass transition point ($Tg_r$) of the binder resin can be obtained on the basis of a heat absorption curve of the binder resin (more specifically, a point of change in specific heat of the binder resin) obtained by using a differential scanning calorimeter (DSC) (such as "DSC-6200" manufactured by Seiko Instruments Inc.). For example, 10 mg of the binder resin (measurement sample) is put in an aluminum pan, and an empty aluminum pan is used as a reference. A heat absorption curve of the binder resin is obtained through measurement performed under conditions of a measurement temperature range from 25° C. to 200° C. and a heating rate of 10° C./minute. The glass transition point ($Tg_r$) of the binder resin can be obtained based on this heat absorption curve of the binder resin.

The binder resin has a softening point ($Tm_r$) of preferably 60° C. or more and 150° C. or less, and more preferably 70° C. or more and 140° C. or less. Alternatively, a plurality of resins having different softening points (Tm) can be combined to obtain a binder resin having a softening point ($Tm_r$) falling in the aforementioned range. The softening point ($Tm_r$) of the binder resin can be measured by the following method.

<Method for Measuring Softening Point>

The softening point ($Tm_r$) of the binder resin can be measured by using an elevated flow tester (such as "CFT-500D" manufactured by Shimadzu Corporation). For example, the softening point ($Tm_r$) can be measured by setting the binder resin (measurement sample) on the elevated flow tester and causing 1 $cm^3$ of the sample to be melt flown under conditions of a die diameter of 1 mm, a plunger load of 20 $kg/cm^2$, and a heating rate of 6° C./minute. By the measurement with the elevated flow tester, an S shaped curve pertaining to the temperature (° C.)/stroke (mm) can be obtained. The softening point ($Tm_r$) of the binder resin can be read from the thus obtained S shaped curve.

A method for reading the softening point ($Tm_r$) of the binder resin will be described with reference to FIG. 1. By the measurement with the elevated flow tester, an S shaped curve, for example, as illustrated in FIG. 1 can be obtained. It is assumed in this S shaped curve that the maximum value of the stroke is $S_1$ and that a stroke value corresponding to a low-temperature-side base line is $S_2$. On the S shaped curve, a temperature corresponding to a stroke value of $(S_1+S_2)/2$ corresponds to the softening point ($Tm_r$) of the binder resin (measurement sample).

If a polyester resin is used as the binder resin, the polyester resin has a number average molecular weight (Mn) of preferably 1000 or more and 2000 or less. A molecular weight distribution (Mw/Mn) of the polyester resin expressed as a ratio between the number average molecular weight (Mn) and a mass average molecular weight (Mw) of the polyester resin is preferably 9 or more and 21 or less. If a styrene acrylic-based resin is used as the binder resin, the styrene acrylic-based resin has a number average molecular weight (Mn) of preferably 2000 or more and 3000 or less. A molecular weight distribution (Mw/Mn) of the styrene acrylic-based resin expressed as a ratio between the number average molecular weight (Mn) and the mass average molecular weight (Mw) of the styrene acrylic-based resin is preferably 10 or more and 20 or less. The number average molecular weight (Mn) and the mass average molecular weight (Mw) of the binder resin can be measured by gel permeation chromatography.

[Magnetic Powder]

The toner core contains a magnetic powder in the toner of the present embodiment. A toner useable as a one-component developer can be produced by using a toner core containing a magnetic powder. Examples of a suitable magnetic powder contained in the toner core include iron such as ferrite and magnetite; ferromagnetic metals such as cobalt and nickel; alloys containing iron and/or a ferromagnetic metal; compounds containing iron and/or a ferromagnetic metal; ferromagnetic alloys having been ferromagnetized (e.g., by heating); and chromium dioxide.

The particle size of the magnetic powder is preferably 0.1 μm or more and 1.0 μm or less, and more preferably 0.1 μm or more and 0.5 μm or less. If a magnetic powder having a particle size of 0.1 μm or more and 1.0 μm or less is used, the magnetic powder can be easily homogeneously dispersed in the binder resin.

The toner of the present disclosure is produced using a toner core whose amount of eluted iron measured through the following steps (1) to (4) is 10 mg/L or less.

The step (1) is keeping 2 g of the toner core suspended at 60° C. for 6 hours in 50 mL of an aqueous solution of benzohydroxamic acid having a pH adjusted to 4 and a concentration of 2% by mass to obtain a suspension.

The step (2) is filtering the suspension (suspension containing the toner core) obtained in the step (1) to obtain a filtrate.

The step (3) is measuring the absorbance of the filtrate obtained in the step (2) for a light beam having a wavelength of 440 nm.

The step (4) is measuring the amount of iron eluted from the toner core as an iron concentration (mg/L) in the filtrate based on the absorbance measured in the step (3) with a standard curve (e.g., a standard curve relating to the concentration of benzohydroxamic acid-iron complex in an aqueous solution and the absorbance of the aqueous solution of benzohydroxamic acid-iron complex for a light beam having a wavelength of 440 nm).

The inventors have found through extensive studies that when a shell layer is formed through a reaction of a monomer of a thermosetting resin on the surface of the toner core containing a magnetic powder, iron eluted from the toner core into an aqueous dispersion of the toner core inhibits the formation of the shell layer. The inventors have also found that reducing the amount of iron eluted from the toner core in the formation of the shell layer allows a favorable reaction of the monomer of the thermosetting resin on the surface of the toner core, thereby forming a suitable shell layer.

Examples of a method for reducing the amount of iron eluted from the toner core include the following first to forth methods.

The first method is to use a magnetic powder having a larger particle size. However, if the magnetic powder has a too large particle size, properties of the toner (particularly, magnetic properties) may be impaired.

The second method is to reduce the amount of the magnetic powder to be used. However, if the amount of the magnetic powder to be used is reduced too much, properties of the toner (particularly, magnetic properties) may be impaired.

The third method is to use a toner core having a larger particle size. However, if the toner core has a too large particle size, properties of the toner (particularly, properties associated with image formation) may be impaired.

The forth method is to use a surface-treated magnetic powder.

The forth method is particularly preferable out of the aforementioned methods as producing a greater effect of reducing the amount of eluted iron and tending to have less impact on properties of the toner.

Various organic materials or inorganic materials can be used as the surface treating agent to be used for the surface treatment of the magnetic powder in the fourth method. Suitable examples of the surface treating agent include hydrolyzable silanes or partial hydrolysates thereof such as tetramethoxysilane, tetraethoxysilane, tetra-n-propoxysilane, tetraisopropoxysilane, tetra-n-butoxysilane, methyltrimethoxysilane, methyltriethoxysilane, methyltri-n-propoxysilane, methyltriisopropoxysilane, methyltri-n-butoxysilane, ethyltrimethoxysilane, ethyltriethoxysilane, ethyltri-n-propoxysilane, ethyltriisopropoxysilane, or ethyltri-n-butoxysilane; silane coupling agents such as n-hexyltrimethoxysilane, n-hexyltriethoxysilane, n-octyltriethoxysilane, n-decyltrimethoxysilane, vinyltrimethoxysilane, vinyltriethoxysilane, allyltrimethoxysilane, 3-methacryloxypropyltrimethoxysilane, 3-methacryloxypropyldimethoxysilane, 3-aminopropyltrimethoxysilane, 3-aminopropyltriethoxysilane, 3-(2-aminoethyl)aminopropyltrimethoxysilane, or 3-phenylaminopropyltrimethoxysilane; titanate coupling agents such as isopropyl triisostearoyl titanate, isopropyl tridodecylbenzenesulfonyl titanate, or isopropyltris(dioctylpyrophosphate) titanate; aluminum coupling agents such as acetoalkoxy aluminum diisopropylate; water glass (sodium silicate); and alum (aluminum sulfate).

Preferably, the amount of the surface treating agent to be used for the surface treatment of the magnetic powder is adjusted from the viewpoint of the particle size, the specific surface area, and the like of the magnetic powder.

The amount of the magnetic powder to be used in a toner for a one-component developer is preferably 35 parts by mass or more and 60 parts by mass or less, and more preferably 40 parts by mass or more and 60 parts by mass or less when the total amount of the toner is 100 parts by mass. The amount of the magnetic powder to be used in a toner for a two-component developer is preferably 20 parts by mass or less, and more preferably 15 parts by mass or less when the total amount of the toner is 100 parts by mass.

[Colorant]

When a toner is produced using a toner core containing a magnetic powder, the color of the toner tends to be black. Therefore, a colorant may not be used if not necessary. For purpose of adjusting an image to be formed using the toner to a more preferable hue, a dye or a pigment may be included as a colorant in the toner core. Examples of the colorant include pigments such as carbon black and dyes such as Acid violet.

[Mold Releasing Agent]

The toner core may contain a mold releasing agent if necessary. The mold releasing agent is used generally for purpose of improving the fixability or the offset resistance of the toner.

Suitable examples of the mold releasing agent include aliphatic hydrocarbon waxes such as low molecular weight polyethylene, low molecular weight polypropylene, polyolefin copolymers, polyolefin wax, microcrystalline wax, paraffin wax, and Fischer-Tropsch wax; oxides of the aliphatic hydrocarbon waxes such as polyethylene oxide wax, and a block copolymer of polyethylene oxide wax; vegetable waxes such as candelilla wax, carnauba wax, Japan wax, jojoba wax, and rice wax; animal waxes such as beeswax, lanolin, and spermaceti wax; mineral waxes such as ozokerite, ceresin, and petrolatum; waxes containing a fatty acid ester as a principal component such as montanic acid ester wax, and castor wax; and waxes obtained by deoxidizing part or whole of fatty acid ester such as deoxidized carnauba wax.

The amount of the mold releasing agent to be used is preferably 1 part by mass or more and 30 parts by mass or less, and more preferably 5 parts by mass or more and 20 parts by mass or less based on 100 parts by mass of the binder resin.

[Charge Control Agent]

A charge control agent is used for purpose of improving the charge level or the charge rising property of a toner, so as to obtain a toner excellent in the durability or the stability. The charge rising property of a toner is an index whether or not the toner can be charged to prescribed charge level in a short period of time.

If development is performed with the toner positively charged, a positively chargeable charge control agent is preferably used. If the development is performed with the toner negatively charged, a negatively chargeable charge control agent is preferably used. If sufficient chargeability is secured in the toner, however, there may be no need to use a charge control agent. For example, if a component having a charging function is contained in the shell layer, there may be no need to add a charge control agent to the toner core.

[Resin Constituting Shell Layer]

The resin constituting the shell layer contains the unit derived from the monomer of the thermosetting resin and the unit derived from the thermoplastic resin.

It is noted that the unit derived from the monomer of the thermosetting resin means, in the specification and the appended claims, a unit obtained by introducing a methylene group (—$CH_2$—) derived from formaldehyde into a monomer such as melamine, for example.

The resin constituting the shell layer is formed through a reaction between the monomer of the thermosetting resin and the thermoplastic resin. The unit derived from the thermoplastic resin is crosslinked by the unit derived from the monomer of the thermosetting resin. Therefore, the shell layer of the toner of the present embodiment has suitable flexibility owing to the unit derived from the thermoplastic resin as well as suitable mechanical strength owing to a three-dimensional crosslinked structure formed by the monomer of the thermosetting resin. Accordingly, the shell layer of the toner of the present embodiment is not easily broken during storage or transportation but is easily broken by applying heat and pressure in fixing the toner. For these reasons, the toner of the present embodiment is excellent in the high-temperature preservability even if the shell layer is thin Now, materials suitably used for forming the resin constituting the shell layer (i.e., examples of the monomer of the thermosetting resin, and the thermoplastic resin) will be described.

(Monomer of Thermosetting Resin)

A monomer or prepolymer used for introducing the unit derived from the monomer of the thermosetting resin into the resin constituting the shell layer is a monomer or a prepolymer used in forming one or more thermosetting resins selected from the group of amino resins consisting of a melamine resin, a urea resin, and a glyoxal resin, for example.

The melamine resin is a polycondensate of melamine and formaldehyde. A monomer used for forming the melamine resin is melamine. The urea resin is a polycondensate of urea and formaldehyde. A monomer used for forming the urea resin is urea. The glyoxal resin is a polycondensate of formaldehyde, and a reaction product of glyoxal and urea. A monomer used for forming the glyoxal resin is a reaction product of glyoxal and urea. Each of the melamine used for forming the melamine resin, the urea used for forming the urea resin, and the urea to be reacted with glyoxal may be modified by a known method. The monomer of the thermosetting resin may be methylolated (derivatized) by formaldehyde before reacting with the thermoplastic resin.

The shell layer of the toner of the present embodiment contains a nitrogen atom derived from melamine or urea. Therefore, the toner of the present embodiment having the shell layer containing the nitrogen atom can be easily positively charged. Therefore, if the toner of the present embodiment is positively charged to form an image, toner particles contained in the toner can be easily positively charged to have a desired charge amount. In order to positively charge the toner particles contained in the toner to have a desired charge amount, the content of the nitrogen atom in the shell layer is preferably 10% by mass or more.

(Thermoplastic Resin)

The thermoplastic resin used for introducing the unit derived from the thermoplastic resin into the resin constituting the shell layer is preferably a thermoplastic resin having a functional group reactive with a functional group (such as a methylol group or an amino group) of the aforementioned monomer of the thermosetting resin. Examples of the functional group reactive with a methylol group or an amino group include functional groups including an active hydrogen atom such as a hydroxyl group, a carboxyl group, and an amino group. An amino group may be contained in the thermoplastic resin in the form of a carbamoyl group (—$CONH_2$). The thermoplastic resin is preferably a resin containing a unit derived from (meth)acrylamide, or a resin containing a unit derived from a monomer having a functional group such as a carbodiimide group, an oxazoline group, or a glycidyl group because the shell layer can be easily formed when such a resin is used.

Specific examples of the thermoplastic resin used for forming the shell layer include (meth)acrylic-based resins, styrene-(meth)acrylic-based copolymer resins, silicone-(meth)acrylic graft copolymers, polyurethane resins, polyester resins, polyvinyl alcohols, and ethylene vinyl alcohol copolymers. Such resins may contain a unit derived from a monomer having a functional group such as a carbodiimide group, an oxazoline group, or a glycidyl group. Among these resins, the thermoplastic resin such as a (meth)acrylic-based resin, a styrene-(meth)acrylic-based copolymer resin, or a silicone-(meth)acrylic graft copolymer is preferable, and a (meth)acrylic-based resin is more preferable.

Examples of a (meth)acrylic-based monomer usable for preparing the (meth)acrylic-based resins include (meth)acrylic acid; alkyl(meth)acrylate such as methyl(meth)acrylate, ethyl(meth)acrylate, n-propyl(meth)acrylate, or n-butyl(meth)acrylate; aryl(meth)acrylate such as phenyl(meth)acrylate; hydroxyalkyl(meth)acrylate such as 2-hydroxyethyl(meth)acrylate, 3-hydroxypropyl(meth)acrylate, 2-hydroxypropyl(meth)acrylate, or 4-hydroxybutyl(meth)acrylate; (meth)acrylamide; an ethylene oxide adduct of (meth)acrylic acid; alkyl ether of an ethylene oxide adduct of (meth)acrylic ester(methyl ether, ethyl ether, n-propyl ether, or n-butyl ether).

The shell layer is formed preferably in an aqueous medium. Thus, elution of a mold releasing agent component contained in the toner core, or dissolution of the binder resin can be suppressed. The thermoplastic resin used for forming the shell layer is preferably water-soluble. Besides, the thermoplastic resin used for forming the shell layer is preferably a resin that can chemically bind to both of the monomer of the thermosetting resin and the toner core in an aqueous medium. An aqueous solution of the thermoplastic resin is preferably used for forming the shell layer.

A ratio (Ws/Wp), in the resin constituting the shell layer, of a content (Ws) of the unit derived from the monomer of the thermosetting resin to a content (Wp) of the unit derived from the thermoplastic resin is preferably 3/7 or more and 8/2 or less, and more preferably 4/6 or more and 7/3 or less.

The thickness of the shell layer is preferably 1 nm or more and 20 nm or less, and more preferably 1 nm or more and 10 nm or less. If an image is formed by using a toner containing toner particles having a too thick shell layer, the shell layer is difficult to break in fixing the toner onto a recording medium even if a pressure is applied to the toner particles. Furthermore, the binder resin and the mold releasing agent contained in the toner core are not rapidly softened and molten, and hence, the toner is difficult to fix on a recording medium in a low-temperature region. On the other hand, if the shell layer is too thin, the strength of the shell layer is low. If the strength of the shell layer is low, the shell layer may be broken by impact caused in a situation of transportation or the like. Besides, if the toner is stored at a high temperature, toner particles having a shell layer at least partly broken are easily aggregated. This is because a component such as the mold releasing agent can easily exude onto the surface of the toner particle through a broken portion of the shell layer under a high-temperature condition.

The thickness of the shell layer can be measured by analyzing a TEM image of the cross-section of the toner particle by using commercially available image analysis software. As the commercially available image analysis software, WinROOF (manufactured by Mitani Corporation) can be used.

If the shell layer is too thin, it may be difficult to measure the thickness of the shell layer because the interface between the shell layer and the toner core is unclear on a TEM image. In such a case, with a TEM image combined with energy dispersive X-ray spectroscopic analysis (EDX), mapping of an element characteristic to the material of the shell layer (such as nitrogen) may be performed on the TEM image, so as to clear the interface between the shell layer and the toner core, and then, the thickness of the shell layer is measured.

The thickness of the shell layer may be adjusted by adjusting the amounts of the materials to be used for forming the shell layer (such as the monomer of the thermosetting resin, and the thermoplastic resin). The thickness of the shell layer can be presumed, for example, based on the specific surface area of the toner core, the amount of the monomer of the thermosetting resin, and the amount of the thermoplastic resin in accordance with the following formula:

Thickness of shell layer=(amount of monomer of thermosetting resin+amount of thermoplastic resin)/specific surface area of toner core

[External Additive]

In the toner of the present embodiment, an external additive may be adhered to the surface of the shell layer as occasion demands.

Examples of the external additive include silica and a metal oxide (such as alumina, titanium oxide, magnesium oxide, zinc oxide, strontium titanate, or barium titanate).

The external additive has a particle size of preferably 0.01 μm or more and 1.0 μm or less.

The amount of the external additive to be used is preferably 1 part by mass or more and 10 parts by mass or less, and more preferably 2 parts by mass or more and 5 parts by mass or less based on 100 parts by mass of toner mother particles.

A suitable example of the method for producing the toner of the present embodiment as described above will be described.

[Method for Producing Toner Core]

As a method for producing the toner core, a method in which a magnetic powder and components to be added as needed (e.g., a colorant, a charge control agent, and a mold releasing agent) can be satisfactorily dispersed in the binder resin is preferably employed.

A frictional charge amount of the toner core measured by using a standard carrier (more specifically, a frictional charge amount measured by a method described later) is preferably negative (namely, lower than 0 μC/g), and more preferably −20 μC/g or more and −5 μC/g or less. If the toner core having such characteristics is used, the shell layer can be easily formed uniformly on the surface of the toner core.

More specifically, if a shell layer is formed on the surface of a toner core in an aqueous medium, there is a tendency that a uniform shell layer cannot be formed on the surface of a toner core unless toner cores are highly dispersed in the aqueous medium containing a dispersant. If at least one of the zeta potential and the frictional charge amount of the toner core is negative as described above, however, the toner core is negatively charged easily when stirred in the aqueous medium. When the toner core is negatively charged, the monomer of the thermosetting resin, which is a nitrogen-containing compound and is positively charged in an aqueous medium, is probably electrically drawn to the toner core. Besides, there is a tendency that a reaction between the monomer of the thermosetting resin having been adsorbed onto the toner core and the thermoplastic resin is satisfactorily proceeded on the surface of the toner core. Since the reaction is satisfactorily proceeded on the surface of the toner core, the shell layer can be easily formed on the surface of the toner core even if the toner cores are not highly dispersed in the aqueous medium by using a dispersant.

If the toner is produced using the toner core showing negative polarity in the frictional charge amount, it seems as described above that a toner particle containing a toner core coated with a shell layer can be easily obtained without using a dispersant. Besides, if the toner is produced without using a dispersant, which causes extremely high drainage load, the concentration of total organic carbon in a drainage can be probably suppressed to a low level (of, for example, 15 mg/L or less) without diluting the drainage released during the production of the toner.

<Method for Measuring Frictional Charge Amount>

One hundred (100) parts by mass of a standard carrier N-01 (a standard carrier for a negatively chargeable toner) available from The Imaging Society of Japan, and 7 parts by mass of the toner core are mixed by using a mixer (e.g., "Turbula mixer" manufactured by Sinmaru Enterprises Corporation). After the mixing, the frictional charge amount of the toner core is measured by using a QM meter (e.g., "MODEL 210HS-2A" manufactured by TREK Inc.) The frictional charge amount of the toner core thus measured is used as an index for determining how easily the toner core can be charged (or which polarity, positive or negative, the toner core can be easily charged to).

Examples of the method for producing the toner core include a melt kneading method and an aggregation method. Toner core can be produced more easily by the melt kneading method than by the aggregation method. Toner core having uniform shape and particle size can be more easily produced by the aggregation method. Toner core with high sphericity can be more easily produced by the aggregation method than by the melt kneading method. According to the method for producing the toner of the present embodiment, the toner core contracts owing to its surface tension during the progress of a curing reaction of the shell layer, and thus the slightly softened toner core is spheronized. Since the toner core is spheronized during the formation of the shell layer, the method for producing the toner of the present embodiment can achieve production of a toner with high sphericity even if the toner core before the formation of the shell layer has low sphericity.

<Melt Kneading Method>

In the melt kneading method, a binder resin, a magnetic powder, and an internal additive to be added if necessary (e.g., an arbitrary component such as a colorant, a mold releasing agent, and a charge control agent) are mixed. Subsequently, the resultant mixture is melt kneaded. Thereafter, the resultant melt kneaded product is pulverized and classified. Thus, a toner core having a desired particle size can be obtained.

<Aggregation Method>

In the aggregation method, fine particles containing components of the toner core such as the binder resin, the magnetic powder, the mold releasing agent, and the colorant are aggregated in an aqueous medium to form aggregated particles. Subsequently, the resultant aggregated particles are heated to coalesce the components contained in the aggregated particles. Thus, an aqueous dispersion containing the toner core is obtained. Thereafter, a component such as a dispersant is removed from the aqueous dispersion thereby to obtain toner cores.

[Method for Forming Shell Layer]

The shell layer coating the toner core can be formed by causing a reaction between the monomer of the thermosetting resin (melamine, urea, or a reaction product of glyoxal and urea) and the thermoplastic resin. Alternatively, instead of the monomer of the thermosetting resin, a precursor (a methylolated product) generated through an addition reaction of the monomer of the thermosetting resin and formaldehyde may be used. Incidentally, in order to prevent dissolution of the binder resin or exudation of the mold releasing agent contained in the toner core into a solvent used for forming the shell layer, the shell layer is preferably formed in an aqueous medium such as water.

The shell layer is formed preferably by adding toner cores to an aqueous solution of the materials for forming the shell layer. Examples of a method for satisfactorily dispersing the toner cores in an aqueous medium include a method in which the toner cores are mechanically dispersed in the aqueous medium by using an apparatus capable of powerfully stirring a dispersion (hereinafter referred to as the first dispersion method), and a method in which the toner cores are dispersed in the aqueous medium containing a dispersant (hereinafter referred to as the second dispersion method). In the second dispersion method, the toner cores are readily dispersed in the aqueous medium in a homogeneous manner. Therefore, a shell layer completely coating each toner core (preventing the surface of each toner core from exposing) can be easily formed by the second dispersion method. On the other hand, an amount of total organic carbon in a drainage or the amount of the dispersant in the toner particles (toner mother particles) can be reduced in the first dispersion method. If the dispersant remains in the toner particles (toner mother particles), the dispersant may inhibit the charging of the toner particles in some cases. A suitable example of the stirrer used in the first dispersion method includes HIVIS MIX (manufactured by Primix Corporation).

The pH of the aqueous dispersion containing the toner core is preferably adjusted to approximately 4 by using an acidic substance before forming the shell layer. By adjusting the pH of the dispersion to be on the acidic side, condensation polymerization of the materials used for forming the shell layer described later (hereinafter referred to as shell materials) can be accelerated.

After the adjustment of the pH of the aqueous dispersion containing the toner core, the shell materials may be dissolved in the aqueous dispersion containing the toner core as occasion demands. Thereafter, the reaction between the shell materials is proceeded on the surface of the toner core in the aqueous dispersion, so that the shell layer coating the surface of the toner core can be formed.

The temperature at which the shell layer is formed by causing the reaction between the monomer of the thermosetting resin and the thermoplastic resin is preferably 40° C. or more and 95° C. or less, and more preferably 50° C. or more and 80° C. or less. If the shell layer is formed at a temperature of 40° C. or more and 95° C. or less, the formation of the shell layer can be satisfactorily proceeded.

In the case where the binder resin contains a resin having a hydroxyl group or a carboxyl group (such as a polyester resin), if the shell layer is formed at a temperature of 40° C. or more and 95° C. or less, there is a tendency that the hydroxyl group or the carboxyl group exposed on the surface of the toner core is reacted with the methylol group of the monomer of the thermosetting resin to form a covalent bond between the binder resin contained in the toner core and the resin contained in the shell layer. As a result, the shell layer is easily firmly adhered to the toner core.

After forming the shell layer as described above, the aqueous dispersion containing the toner core coated with the shell layer is cooled to room temperature, and thus, a dispersion of toner mother particles can be obtained. Thereafter, for example, a washing process for washing the toner mother particles, a drying process for drying the toner mother particles, and an external addition process for adhering an external additive to the surfaces of the toner mother particles are performed, and then, a toner is collected from the dispersion of the toner mother particles. The washing process, the drying process, and the external addition process will now be described. It is noted that any of the washing process, the drying process, and the external addition process may be appropriately omitted.

[Washing Process for Toner Mother Particles]

The toner mother particles are washed with water if necessary. As a suitable example of a method for washing the toner mother particles, the toner mother particles are collected as a wet cake by solid-liquid separating the toner mother particles from the aqueous medium containing the toner mother particles by a centrifugal separation method or a filter press method, and the obtained wet cake is washed with water.

[Drying Process for Toner Mother Particles]

The toner mother particles may be dried if necessary. Examples of a suitable method for drying the toner mother particles include methods in which a dryer such as a spray dryer, a fluidized-bed dryer, a vacuum freeze dryer, or a vacuum dryer is used. The method in which a spray dryer is used is more preferable for suppressing the aggregation of the toner mother particles during the drying process. If a spray dryer is used, an external additive such as silica may be adhered to the surfaces of the toner mother particles by spraying, together with the dispersion of the toner mother particles, a dispersion of the external additive.

[External Addition Process]

An external additive may be adhered to the surfaces of the toner mother particles obtained as described above if necessary. As a suitable example of a method for adhering an external additive to the surfaces of the toner mother particles, the toner mother particles and the external additive are mixed by using a mixer such as an FM mixer or a Nauta mixer under conditions where the external additive is not buried in a surface portion of the toner mother particle. By adhering the external additive to the surfaces of the toner mother particles, the toner particles are obtained. Incidentally, if no external additive is adhered to the surfaces of the toner mother particles (namely, the external addition process is omitted), the toner mother particles correspond to the toner particles.

The magnetic toner for developing an electrostatic latent image of the present embodiment described so far is excellent in the high-temperature preservability. The toner is easily charged to a desired charge amount even under a high-temperature and high-humidity environment. Where the above-described toner is used as a developer to form an image, the toner is less likely to abrade the surface of a photosensitive member. Furthermore, toner particles are less likely to be aggregated in the production of the toner. Therefore, the magnetic toner for developing an electrostatic latent image of the present embodiment can be suitably used in any of various image forming apparatuses.

EXAMPLES

The following describes the present disclosure further specifically by using examples. It should be noted that the present disclosure is in no way limited to the scope of the examples.

[Production of Polyester Resin]

A polyester resin having a glass transition point of 53.8° C., a softening point of 100.5° C., a number average molecular weight (Mn) of 1460, a molecular weight distribution (Mw/Mn) of 12.7, an acid value of 16.8 mgKOH/g, and a hydroxyl value of 22.8 mgKOH/g was produced by the following method.

A 5 L four-necked flask was charged with 1245 g of terephthalic acid, 1245 g of isophthalic acid, 1248 g of bisphenol A ethylene oxide adduct, and 744 g of ethylene glycol. Subsequently, after replacing the atmosphere inside the flask with nitrogen, the temperature within the flask was increased to 250° C. under stirring. Then, after the reaction was performed at normal pressure and 250° C. for 4 hours, 0.875 g of antimony trioxide, 0.548 g of triphenyl phosphate, and 0.102 g of tetrabutyl titanate were added to the flask. Thereafter, the pressure within the flask was reduced to 0.3 mmHg, and the temperature within the flask was increased to 280° C. Subsequently, the reaction was performed at 280° C. for 6 hours to give a polyester resin having a number average molecular weight of 1300. Then, 30.0 g of trimellitic acid was added as a crosslinking agent to the flask, the pressure within the flask was restored to normal pressure, and the temperature within the flask was lowered to 270° C. Thereafter, the contents within the flask were reacted at normal pressure and 270° C. for 1 hour. After completing the reaction, the content of the flask was taken out and cooled, thereby giving a polyester resin.

[Production of Magnetic Powder]

Methods for producing magnetic powders A to G will now be described. For the production of the magnetic powders A to G, the same magnetite particles ("PMT-92" manufactured by TODA KOGYO CORP. having an average particle size of 0.18 μm and an octahedral form) were used. The form of the magnetite particles was recognized based on a photograph (at a magnification of 10000× to 50000×) taken with a scanning electron microscope ("JSM-7600 manufactured by JEOL, Ltd.). The average particle size of the magnetite particles was measured in accordance with the following method.

<Method for Measuring Average Particle Size of Magnetite Particles>

The average particle size of the magnetite particles was measured based on an image taken at a magnification of 10000× with a transmission electron microscope ("JSM-7600" manufactured by JEOL Ltd.) and further magnified 4 times. Specifically, 300 arbitrary magnetite particles on the magnified image were measured for the Martin's diameter (equivalent circle diameter). The Martin's diameters of the 300 magnetite particles measured were averaged to determine the average particle size of the magnetite particles.

(Magnetic Powder A)

One hundred (100) parts by mass of magnetite particles and 2 parts by mass of ethyl silicate were mixed by using a homo mixer (manufactured by PRIMIX Co., Ltd.) at a revolution speed of 3000 rpm (hereinafter, mixing with a homo mixer was always performed at the same revolution speed).

Subsequently, the resultant mixture was washed with ion-exchanged water, and then dehydrated by filter press. Subsequently, the mixture was heat-treated by using a thermostat at 200° C. for 3 hours. As a result, the magnetic powder A (surface-treated magnetite particles) was obtained.

(Magnetic Powder B)

One hundred (100) parts by mass of magnetite particles and 300 parts by mass of ion-exchanged water were mixed by using a homo mixer to give an aqueous dispersion of the magnetite particles. Subsequently, the pH of the aqueous dispersion was adjusted to 4 with hydrochloric acid. Subsequently, 2 parts by mass of a methoxysilane coupling agent ("Z-6030" manufactured by Dow Corning Toray Co., Ltd.) was added to the pH-adjusted aqueous dispersion. Subsequently, the aqueous dispersion was mixed by using the homo mixer, thereby causing a coupling reaction. Subsequently, the aqueous dispersion was filtered (solid-liquid separated), and the resultant solid content was dried. As a result, the magnetic powder B (surface-treated magnetite particles) was obtained.

(Magnetic Powder C)

One hundred (100) parts by mass of magnetite particles and 2 parts by mass of sodium silicate (BS No. 3) were mixed by using a homo mixer. Subsequently, the resultant mixture was washed with ion-exchanged water, and then dehydrated by filter press. Such washing and dehydration were repeated twice, thereby removing a sodium component from the mixture. Specifically, the removal of the sodium component was recognized by recognizing that the ion-conductivity in the washing water fell below 10 siemens. After the washing and the dehydration, the mixture was heat-treated with a thermostat at 200° C. for 3 hours. As a result, the magnetic powder C (surface-treated magnetite particles) was obtained.

(Magnetic Powder D)

One hundred (100) parts by mass of magnetite particles and an aqueous solution of 2 parts by mass of alum (manufactured by Nippon Light Metal Co., Ltd) containing aluminum sulfate as a principal component (concentration: 8% by mass) were mixed by using a homo mixer. Subsequently, the resultant mixture was washed with ion-exchanged water, and then dehydrated by filter press. Subsequently, the mixture was heat-treated by using a thermostat at 200° C. for 3 hours. Subsequently, the heat-treated solid was washed with water, and then dried. As a result, the magnetic powder D (surface-treated magnetite particles) was obtained.

(Magnetic Powder E)

One hundred (100) parts by mass of magnetite particles and 300 parts by mass of ion-exchanged water were mixed by using a homo mixer. Thus, an aqueous dispersion containing the magnetite particles was obtained. Subsequently, the pH of the aqueous dispersion was adjusted to 9 with sodium hydroxide. Subsequently, 2 parts by mass of an aminosilane coupling agent ("Z-6011" manufactured by Dow Corning Toray Co., Ltd.) was added to the pH-adjusted aqueous dispersion. Subsequently, the aqueous dispersion was mixed by using the homo mixer, thereby causing a coupling reaction. Subsequently, the aqueous dispersion was filtered (solid-liquid separated), and the solid content was dried. As a result, the magnetic powder E (surface-treated magnetite particles) was obtained.

(Magnetic Powder F)

Magnetite particles were used as the magnetic powder F as is (not surface-treated).

(Magnetic Powder G)

The magnetic powder G was obtained in the same manner as in the production of the magnetic powder A except that the amount of ethyl silicate was changed from 2 parts by mass to 0.5 parts by mass.

[Production of Toner Core]

Toner cores were produced by using the magnetic powders shown in Tables 1 and 2.

TABLE 1

| | Examples | | | |
|---|---|---|---|---|
| | 1 | 2 | 3 | 4 |
| Magnetic powders | | | | |
| Types | A | B | C | D |
| Frictional charge amount [μC/g] | −2 | −15 | −10 | −5 |
| Amount of eluted iron [mg/L] | 20 | 35 | 55 | 25 |
| Toner cores | | | | |
| Frictional charge amount [μC/g] | −10 | −15 | −10 | −5 |
| Amount of eluted iron [mg/L] | 5.0 | 5.5 | 9.5 | 4.0 |
| Toner physical property values | | | | |
| Amount of eluted iron [mg/L] | 1.0 | 2.5 | 6.0 | 5.0 |
| Thickness of shell layer [nm] | 10 | 10 | 10 | 10 |
| Average roundness | 0.98 | 0.97 | 0.97 | 0.97 |
| Evaluation 1 | | | | |

TABLE 1-continued

| | Examples | | | |
|---|---|---|---|---|
| | 1 | 2 | 3 | 4 |
| High-temperature preservability | | | | |
| Degree of aggregation [% by mass] | 5 | 7 | 10 | 5 |
| Evaluation result | Good | Good | Good | Good |
| Normal temperature, normal humidity (25° C., 50% RH-60% RH) | | | | |
| Charge amount [μC/g] | 20 | 22 | 20 | 15 |
| Evaluation result | Good | Good | Good | Good |
| High temperature, high humidity (32° C., 83% RH-88% RH) | | | | |
| Charge amount [μC/g] | 15 | 17 | 15 | 12 |
| Evaluation result | Good | Good | Good | Good |
| Evaluation 2 | | | | |
| Low-temperature fixability | | | | |
| Lowest fixing temperature [° C.] | 140 | 140 | 140 | 140 |
| Evaluation result | Good | Good | Good | Good |
| Amount of abrasion of photosensitive member | | | | |
| Thickness loss in OPC [μm] | 3 | 3 | 5 | 3 |
| Evaluation result | Good | Good | Good | Good |

TABLE 2

| Comparative Examples | 1 | 2 | 3 |
|---|---|---|---|
| Magnetic powders | | | |
| Types | E | F | G |
| Frictional charge amount [μC/g] | 10 | 5 | −10 |
| Amount of eluted iron [mg/L] | 50.0 | 100.0 | 80.0 |
| Toner cores | | | |
| Frictional charge amount [μC/g] | 20 | 5 | −3 |
| Amount of eluted iron [mg/L] | 20.0 | 40.0 | 60.0 |
| Toner physical property values | | | |
| Amount of eluted iron [mg/L] | 13.0 | 20.0 | 15.0 |
| Thickness of shell layer [nm] | 10 | 10 | 10 |
| Average roundness | 0.97 | 0.96 | 0.98 |
| Evaluation 1 | | | |
| High-temperature preservability | | | |
| Degree of aggregation [% by mass] | 25 | 90 | 60 |
| Evaluation result | Good | Poor | Poor |
| Normal temperature, normal humidity (25° C., 50% RH-60% RH) | | | |
| Charge amount [μC/g] | 20 | 11 | 20 |
| Evaluation result | Good | Good | Good |
| High temperature, high humidity (32° C., 83% RH-88% RH) | | | |
| Charge amount [μC/g] | 7 | 5 | 7 |
| Evaluation result | Poor | Poor | Poor |
| Evaluation 2 | | | |
| Low-temperature fixability | | | |
| Lowest fixing temperature [° C.] | 145 | 135 | 140 |
| Evaluation result | Good | Good | Good |
| Amount of abrasion of photosensitive member | | | |
| Thickness loss in OPC [μm] | 6 | 13 | 12 |
| Evaluation result | Good | Poor | Poor |

One hundred (100) parts by mass of polyester resin, 100 parts by mass of the corresponding type of magnetic powder shown in Tables 1 and 2, and 5 parts by mass of a mold releasing agent ("WEP-3" manufactured by NOF Corporation, ester wax) were mixed by using a mixer (an FM mixer) to obtain a mixture. Subsequently, the thus obtained mixture was melt kneaded by using a two screw extruder ("PCM-30" manufactured by Ikegai Corporation) to give a kneaded product. Subsequently, the kneaded product was pulverized by using a mechanical pulverizer ("Turbo Mill" manufactured by Freund Turbo Corporation) to give a pulverized product. Subsequently, the pulverized product was classified by a classifier ("Elbow Jet" manufactured by Nittetsu Mining Co., Ltd.) to obtain a toner core having a volume average particle size ($D_{50}$) of 6.0 μm. The volume average particle size of the toner core was measured by using "Coulter Counter Multisizer 3" manufactured by Beckman Coulter.

[Evaluation of Toner Core]

The resultant toner cores (the toner cores according to Examples 1 to 4 and Comparative Examples 1 to 3) were measured for the frictional charge amount attained by using a standard carrier and for the amount of iron eluted from the toner cores in accordance with methods described below. The measurement results are shown in Tables 1 and 2.

<Method for Measuring Frictional Charge Amount Attained by Using Standard Carrier>

One hundred (100) parts by mass of a standard carrier N-01 (a standard carrier for a negatively chargeable toner) available from The Imaging Society of Japan, and 7 parts by mass of the corresponding type of toner core were mixed for 30 minutes by using a mixer ("Turbula mixer" manufactured by Sinmaru Enterprises Corporation). The thus obtained mixture was used as a measurement sample to measure the frictional charge amount. More specifically, with respect to each measurement sample, the frictional charge amount of the toner core attained through friction with the standard carrier was measured by using a QM meter ("MODEL 210HS-2A" manufactured by TREK Inc.)

<Method for Measuring Amount of Iron Eluted from Toner Core>

The amount of iron eluted from the toner core in an aqueous solution of benzohydroxamic acid having a pH adjusted to 4 was measured through the following steps (1) to (4).

Step (1): A sample (toner core) in an amount of 2 g was kept suspended at 60° C. for 6 hours in 50 mL of an aqueous solution of benzohydroxamic acid having a pH adjusted to 4 and a concentration of 2% by mass to obtain a suspension.

Step (2): The suspension containing the toner core was filtered to obtain a filtrate.

Step (3): The absorbance of the filtrate for a light beam having a wavelength of 440 nm was measured.

Step (4): The amount of iron eluted from the toner core was measured as an iron concentration (mg/L) in the filtrate based on the absorbance measured in the step (3) with a standard curve (a standard curve relating to the concentration of benzohydroxamic acid-iron complex in an aqueous solution and the absorbance of the aqueous solution of benzohydroxamic acid-iron complex for a light beam having a wavelength of 440 nm).

[Shell Layer Forming Process]

A 1 L three-necked flask equipped with a thermometer and a stiffing blade was charged with 300 mL of ion-exchanged water. Subsequently, the temperature within the flask was retained at 30° C. by using a water bath. Then, dilute hydrochloric acid was added to the flask to adjust the pH of an aqueous medium contained in the flask to 4. After adjusting the pH, 2 mL of a methylol melamine aqueous solution ("mirben resin SM-607" manufactured by Showa Denko K.K., having a solid content concentration of 80% by mass) and 2 mL of an aqueous solution of a thermoplastic resin (an aqueous solution of a water soluble polyacrylamide having a solid content concentration of 11% by mass) were added to the flask as materials of the shell layer. Then, the contents of the flask were stirred for dissolving the materials of the shell layer in the aqueous medium. In this manner, a shell layer material aqueous solution (A) was obtained.

To the aqueous solution (A), 300 g of toner cores were added, and the contents of the flask were stirred at a stirring rate of 200 rpm for 1 hour. Subsequently, 500 mL of ion-exchanged water was added to the flask. Then, while stirring the contents of the flask at 100 rpm, the temperature within the flask was increased to 70° C. at a rate of 1° C./minute. Thereafter, the contents of the flask were continuously stirred at 70° C. and 100 rpm for 2 hours. After stirring, the pH of the content of the flask was adjusted to 7 by adding sodium hydroxide to the flask. Then, the content of the flask was cooled to room temperature. In this manner, a dispersion containing toner mother particles was obtained.

In the production of the toners according to Comparative Examples 1 and 2, some of the toner cores were aggregated when the toner cores were added to the shell layer material aqueous solution (A), while toner particles in which the shell layer had been formed were obtained. By contrast, in the production of the toner particles according to Comparative Example 3, the toner cores were significantly aggregated when the toner cores were added to the shell layer material aqueous solution (A), and the shell layer was formed on the aggregated particles of the toner cores. Coarse toner particles were obtained in the production of the toner according to Comparative Example 3. It is inferred that the toner cores were aggregated because iron eluted from the magnetic powder contained in the toner cores became cationic iron ions and attracted the anionic toner cores containing the polyester resin.

[Washing Process]

A wet cake of the toner mother particles was filtered out by using a Buchner funnel from the dispersion containing the toner mother particles. Thereafter, the wet cake of the toner mother particles was dispersed again in ion-exchanged water for washing the toner mother particles. Such filtration and dispersion were repeated five times to wash the toner mother particles.

[Drying Process]

A slurry was prepared by dispersing the wet cake of the toner mother particles in an ethanol aqueous solution in a concentration of 50% by mass. The thus obtained slurry was supplied to a continuous surface modifying apparatus ("Coatmizer" manufactured by Freund Industrial Co., Ltd.) to dry the toner mother particles contained in the slurry. In this manner, dried toner mother particles were obtained. The drying conditions employed in using Coatmizer were a hot air temperature of 45° C. and a blower air flow rate of 2 $m^3$/minute.

[External Addition Process]

One hundred (100) parts by mass of the toner mother particles resulting from the drying process and 0.5 parts by mass of silica ("REA90" manufactured by Nippon Aerosil Co., Ltd.) were mixed for 5 minutes by using a 10 L FM mixer (manufactured by Nippon Coke and Engineering Co., Ltd.) for adhering the external additive to the toner mother particles. Thereafter, the resultant toner particles were sifted by a 200 mesh sieve (having an opening of 75 μm).

[Evaluation of Toner]

Each of the resultant toners (toners of Examples 1 to 4 and Comparative Examples 1 to 3) was measured for the amount of iron eluted from the toner particles, the thickness of the shell layers of the toner particles, the average roundness, the high-temperature preservability, the charge amount under specified environments, the low-temperature fixability, and the amount of abrasion of the photosensitive member by the following methods. The measurement results are shown in Tables 1 and 2. The method for measuring the amount of iron eluted from the toner particles was the same as the method for measuring the amount of iron eluted from the toner cores.

<Method for Measuring Thickness of Shell Layer>

The thickness of the shell layer was measured on a TEM photograph of a cross-section of a toner particle as follows.

A sample (toner) was dispersed in a cold-setting epoxy resin, and the resultant was allowed to stand still in an atmosphere of 40° C. for 2 days to give a cured resin including the toner. Subsequently, the cured resin was dyed with osmium tetroxide. Subsequently, a thin sample with a thickness of 200 nm was cut out from the dyed cured resin by using a microtome ("EM UC6" manufactured by Leica). The cut surface of the thin sample included a cross-section of a toner particle. The thus obtained thin sample was observed by using a transmission electron microscope (TEM) ("JSM-6700F" manufactured by JEOL Ltd.) at a magnification of 3000 times and 10000×. In addition, a TEM photograph of the cross-section of the toner particle was taken.

The thickness of the shell layer was measured by analyzing the TEM photograph of the cross-section of the toner particle by using image analysis software ("WinROOF" manufactured by Mitani Corporation). Specifically, two straight lines were drawn to cross at substantially the center of the cross-section of a toner particle, and the lengths of four sections of the two straight lines crossing the shell layer were measured. An average of the thus measured lengths of the four sections was defined as an evaluation value of one toner particle (the thickness of the shell layer of one toner particle measured). Furthermore, this measurement of the thickness of the shell layer was performed on 10 toner particles contained in the sample (toner). An average of the thicknesses of the shell layers of the 10 toner particles measured (the evaluation values of the respective toners) was obtained to be defined as an evaluation value of the toner (the thickness of the shell layer of the toner measured).

<Method for Measuring Average Roundness>

An average roundness of toner particles having a particle size of 3 μm or more and 10 μm or less contained in a sample (toner) was measured by using a flow particle image analyzer ("FPIA (registered trademark in Japan)-3000" manufactured by Sysmex Corporation). Specifically, the roundnesses of toner particles having an equivalent circle diameter in a range of 0.60 μm or more and 400 μm or less were determined by measuring a length ($L_0$) of the circumference of a circle having the same area as the area of a projected image of each toner particle and a length (L) of the outer circumference of the projected image of the toner particle under an environment at 23° C. and 60% RH, and substituting them into the following equation. A value obtained by dividing the total of the roundnesses of toner particles having an equivalent circle diameter of 3 μm or more and 10 μm or less by the number of the toner particles having an equivalent circle diameter of 3 μm or more and 10 μm was defined as an evaluation value of the toner (the average roundness of the toner measured).

(Equation for calculating roundness)Roundness=$L_0/L$

<Method for Evaluating High-Temperature Preservability>

Two (2) g of a sample (toner) was placed in a 20 mL plastic vessel, and the resultant was allowed to stand still for 3 hours in a thermostat set at 60° C. Thus, a toner for high-temperature preservability evaluation was obtained. Then, the toner for high-temperature preservability evaluation was sifted by using a 100 mesh sieve (having an opening of 150 μm) placed in a powder tester (manufactured by Hosokawa Micron K.K.) under conditions of a rheostat scale of 5 and time of 30 seconds in accordance with an instruction manual of the powder tester. After sifting, the mass of the toner remaining on the sieve was measured. On the basis of the mass of the toner before sifting and the mass of the toner remaining on the sieve after sifting, a degree of aggregation (% by mass) of the toner was obtained in accordance with the following formula. On the basis of the calculated degree of aggregation, the high-temperature preservability was evaluated in accordance with the following criteria.

Degree of aggregation(% by mass)=(mass of toner remaining on sieve/mass of toner before sifting)×100

Good: The degree of aggregation was 20% by mass or less.

Poor: The degree of aggregation was more than 20% by mass.

<Method for Evaluating Charge Amount of Toner in Specified Environments>

One hundred (100) parts by mass of a standard carrier N-01 (a standard carrier for a negatively chargeable toner) available from The Imaging Society of Japan, and 5 parts by mass of a sample (toner) were mixed by using a mixer ("Turbula mixer" manufactured by Sinmaru Enterprises Corporation) for 10 minutes in a normal-temperature and normal-humidity environment (25° C., 50% RH to 60% RH) and in a high-temperature and high-humidity environment (32° C., 83% RH to 88% RH). Subsequently, the thus obtained mixtures were used as measurement samples and measured for the charge amount of the toner. Specifically, the measurement samples obtained in the normal-temperature and normal-humidity environment and in the high-temperature and high-humidity environment were measured for the charge amount of the toner after being rubbed on the standard carrier by using a QM meter ("MODEL 210HS-2A" manufactured by TREK Inc.) On the basis of the charge amount obtained, the charge amount of the toner was evaluated in accordance with the following criteria.

Good: The charge amount of the toner was 10 μC/g or more and 40 μC/g or less.

Poor: The charge amount of the toner was less than 10 μC/g or more than 40 μC/g.

<Method for Evaluating Low-Temperature Fixability>

One hundred (100) parts by mass of a developer carrier (a carrier for LS-6960DN) and 10 parts by mass of each of the toners were mixed for 30 minutes by using a ball mill. In this manner, a two-component developer was prepared.

As an evaluation apparatus, a printer ("LS-6960DN" manufactured by Kyocera Document Solutions Inc.) modified so that a fixing temperature could be adjusted was used. The two-component developer prepared as described above was supplied to a developing unit of the evaluation apparatus, and the toner was supplied to a toner container of the evaluation apparatus.

The linear speed of the evaluation apparatus was set to 300 mm/second and the toner placement amount of the evaluation apparatus was set to 1.0 mg/cm$^2$, and an unfixed solid image was formed on a recording medium (printing paper). The fixing temperature of a fixing unit of the evaluation apparatus was increased from 100° C. in increments of 5° C. in a range of the fixing temperature from 100° C. inclusive to 200° C. inclusive. Thus, a lowest temperature at which the toner (solid image) could be fixed on the recording medium (lowest fixing temperature) was measured. Whether or not the toner had been fixed was checked by a fold and rub test (measurement of a range of where the fixed toner is removed on a fold). Specifically, the lowest fixing temperature was determined in accordance with the following method.

The fold and rub test was performed on the recording medium on which the solid image had been fixed. Specifically, the recording medium was folded in half in such a manner that the surface having the image would be inside, and the fold was rubbed with a one-kilogram weight covered with a textile for five strokes. Subsequently, the recording medium was unfolded, and the fold of the recording medium (where the solid image had been fixed) was observed. A lowest fixing temperature at which the range of the toner removed on the fold was determined to be 1 mm or less was defined as an evaluation value of the toner (the lowest fixing temperature of the toner).

On the basis of the lowest fixing temperature of the toner measured, the low-temperature fixability of the toner was evaluated in accordance with the following criteria.

Good: The lowest fixing temperature was 160° C. or less.

Poor: The lowest fixing temperature was more than 160° C.

<Method for Measuring Amount of Abrasion of Photosensitive Member>

One hundred (100) parts by mass of a developer carrier (a carrier for FS-1370DN) and 10 parts by mass of each of the toners were mixed for 30 minutes by using a ball mill. In this manner, a two-component developer was prepared.

As an evaluation apparatus, a printer ("FS-1370DN" manufactured by Kyocera Document Solutions Inc., printing 35 sheets/minute) equipped with an organic photoconductor (OPC) as a photosensitive member was used. The two-component developer prepared as described above was supplied to a developing unit of the evaluation apparatus, and the toner was supplied to a toner container of the evaluation apparatus.

First, the thickness of the OPC was measured by using an interferometric spectrometer ("Solid Lambda Thickness" manufactured by Carl Zeiss). The thickness of the OPC before a continuous image formation test was 32 μm. Subsequently, a test was performed by using the evaluation apparatus by continuously forming a pattern image on 100000 sheets of standard paper in accordance with ISO/IEC 19752 (continuous image formation test). Subsequently, the thickness of the OPC was measured under the same conditions as in the measurement before the continuous image formation test (the measurement apparatus and the portion being measured were the same as in the measurement before the continuous image formation test). The thickness loss in the OPC between before and after the continuous image formation test was determined based on the thickness of the OPC measured after the continuous image formation test. Then, the amount of abrasion of the photosensitive member was evaluated in accordance with the following criteria.

Good: The thickness loss in the OPC was 10 μm or less.

Poor: The thickness loss in the OPC was more than 10 μm.

The toners according to Examples 1 to 4 include toner particles each having a toner core containing a binder resin and a magnetic powder, and a shell layer coating a surface of the toner core. The shell layer contains a resin having a unit derived from a monomer of a thermosetting resin and a unit derived from a thermoplastic resin. The thermosetting resin is one or more resins selected from the group of amino resins consisting of a melamine resin, a urea resin, and a glyoxal resin. The amount of iron eluted from the toner core measured as described above is 10 mg/L or less. The toners having such a configuration were less likely to have aggregated toner particles in the production thereof. As shown in Table 1, such toners were excellent in the high-temperature preservability, were charged to have a desired charge amount even in a high-temperature and high-humidity environment, and were less likely to abrade the surface of the photosensitive member in image formation.

By contrast, in the toners according to Comparative Examples 1 to 3, the amount of iron eluted from the toner core measured as described above is more than 10 mg/L. The toners having such a configuration were likely to have aggregated toner cores in the production thereof. As shown in Table 2, such toners were not easily charged to have a desired charge amount in a high-temperature and high-humidity environment. Furthermore, the toners of Comparative Examples 2 and 3, in which the amount of iron eluted from the toner core measured as described above was 40 mg/L or more, easily abraded the surface of the photosensitive member in image formation, and were poor in the high-temperature preservability.

What is claimed is:

1. A magnetic toner for developing an electrostatic latent image, comprising toner particles each having a toner core containing a binder resin and a magnetic powder, and a shell layer coating a surface of the toner core, wherein the shell layer contains a unit derived from a monomer of a thermosetting resin and a unit derived from a thermoplastic resin, the thermosetting resin is one or more resins selected from the group of amino resins consisting of a melamine resin, a urea resin, and a glyoxal resin, and an amount of iron eluted from the toner core is 10 mg/L or less, the amount of iron eluted from the toner core being measured through:

keeping 2 g of the toner core suspended at 60° C. for 6 hours in 50 mL of an aqueous solution of benzohydroxamic acid having a pH adjusted to 4 and a concentration of 2% by mass to obtain a suspension;

filtering the suspension containing the toner core to obtain a filtrate;

measuring an absorbance of the filtrate for a light beam having a wavelength of 440 nm; and measuring the amount of iron eluted from the toner core as an iron concentration in the filtrate based on the absorbance with a standard curve.

2. A magnetic toner according to claim 1, wherein a frictional charge amount of the toner core when 100 parts by mass of a standard carrier and 7 parts by mass of the toner core are mixed by using a mixer is −20 μC/g or more and −5 μC/g or less.

3. A magnetic toner according to claim 1, wherein the shell layer has a thickness of 1 nm or more and 20 nm or less.

* * * * *